United States Patent [19]

Watts

[11] 4,422,137

[45] Dec. 20, 1983

[54] MAGNETIC MOUNTING SUPPORT FOR LIGHT FIXTURE INCLUDING SHOCK ABSORPTIVE ARRANGEMENT

[75] Inventor: Thomas E. Watts, Shorewood, Wis.

[73] Assignee: McGraw-Edison Company, Rolling Meadows, Ill.

[21] Appl. No.: 402,097

[22] Filed: Jul. 26, 1982

[51] Int. Cl.[3] ..... F21V 15/04

[52] U.S. Cl. ..... 362/390; 362/147; 362/378; 248/206 A; 248/467

[58] Field of Search ..... 362/145, 147, 390, 398; 298/206.5, 344, 467

[56] References Cited

U.S. PATENT DOCUMENTS

| | | | |
|---|---|---|---|
| 921,108 | 5/1909 | Hauss | 362/398 X |
| 2,280,505 | 4/1942 | Beck | 362/408 X |
| 2,597,595 | 5/1952 | Ordas | 362/398 X |
| 2,959,832 | 11/1960 | Baermann | 248/206.5 |
| 3,245,165 | 4/1966 | Podoloff | 248/467 |
| 3,361,404 | 1/1968 | Lohr | 248/206.5 |
| 3,552,705 | 1/1971 | Caster | 248/206.5 |
| 3,836,766 | 9/1974 | Auerbach | 362/398 X |
| 4,214,185 | 7/1980 | Breeze | 362/398 X |
| 4,288,848 | 9/1981 | Fido | 362/398 X |

FOREIGN PATENT DOCUMENTS

| | | | |
|---|---|---|---|
| 1374339 | 12/1964 | France | 362/398 |
| 1580920 | 9/1969 | France | 248/206.5 |

*Primary Examiner*—Peter A. Nelson

*Attorney, Agent, or Firm*—Charles W. MacKinnon; Jon Carl Gealow; Ronald J. LaPorte

[57] ABSTRACT

A shock absorptive magnetic mounting support for a light fixture or the like object includes a base having a magnet mounted thereon for magnetically securing the mounting support to the underside of a metallic shelf or support surface. A support shaft upon which the light fixture is mounted has a threaded end portion received in an aperture in the base. A stop adjacent the threaded end portion limits the insertion thereof into the aperture. A rubber washer of a predetermined thickness is received on the threaded end portion of the shaft in abutting relation with the base. A nut, and, if desired, a lock washer, is received on the threaded end portion of the support shaft. The nut is tightened down against the rubber washer to secure the base and support shaft in a joined condition. The shock absorptive arrangement aids in preventing detachment of the magnetic base from the metallic shelf support in the event of the application of force to the upper side of the shelf.

8 Claims, 3 Drawing Figures

MAGNETIC MOUNTING SUPPORT FOR LIGHT FIXTURE INCLUDING SHOCK ABSORPTIVE ARRANGEMENT

BACKGROUND OF THE INVENTION

This invention relates generally to a device for mounting a workpiece upon a support surface and, more particularly, to a magnetically held mounting support for a light fixture or the like object.

A magnetic mounting support for a light fixture of the type illustrated in copending U.S. Patent application, Ser. No. 37,365, filed May 9, 1979, and assigned to the same assignee as the subject invention, includes a support shaft upon which a light fixture is received and a magnetic base joined to the support shaft. The support shaft includes a threaded end which is received in an aperture defined in the magnetic base. The support shaft includes an enlarged stop formed thereon to limit the insertion of the threaded end of the shaft into the base. A flat metallic washer and nut is received on the threaded end of the shaft and the nut is tightened down to secure the base and shaft in a joined condition.

The magnetic base is used frequently to attach the support to the underside of a metallic shelf with the support shaft suspended from the base. A light fixture is received on the support shaft and is mounted thereon over a table, desk, or similar surface for illumination thereof.

While the aforementioned magnetic mounting support is, for the most part, effective in mounting a light fixture on the underside of a metallic shelf or other metallic support surfaces, as described, the mounting support suffers one drawback. In certain instances, if a relatively heavy item is dropped or placed forcibly onto the upper side of the shelf on which the mounting support is magnetically held, the magnetic base will be jarred free, causing the light fixture or other objects suspended from the mounting support to drop with the mounting support to the table surface below. Such an occurrence is infrequent, but if it should happen, could cause damage to the light fixture or possibly to objects placed on the surface below the shelf.

SUMMARY OF THE INVENTION

Accordingly, it is a primary object of the present invention to provide a new and improved magnetic mounting support for a light fixture or other object which overcomes the drawback of the prior art mounting support described heretofore.

It is another object of the present invention to provide a new and improved magnetic mounting support of the last-mentioned type, the cost of which is only slightly greater than the aforementioned prior art magnetic mounting support.

Briefly, a preferred embodiment of an improved magnetic mounting support, according to the invention, includes a support shaft having a threaded end and a magnetic base defining an aperture therein into which the threaded end of the shaft is received. An enlarged stop formed on the support shaft limits the insertion of the threaded end of the support shaft through the aperture of the base. A toroidal, resilient, preferably rubber, washer is received on the threaded end of the support shaft in abutting relation with the base. A metallic washer, preferably of the locking type, having radially inwardly extending teeth spaced thereabout, is received on the shaft in engagement with the rubber washer. A nut is received thereover and is tightened down against the metallic washer to secure the support shaft and base in a joined condition.

The provision of the rubber washer effectively placed as described provides a shock absorptive arrangement which is effective to prevent detachment of the magnetic base from the metallic shelf even when considerable force is applied to the upper side of the shelf to which the mounting support is attached magnetically.

DETAILED DESCRIPTION OF THE DRAWING

Figure 1:
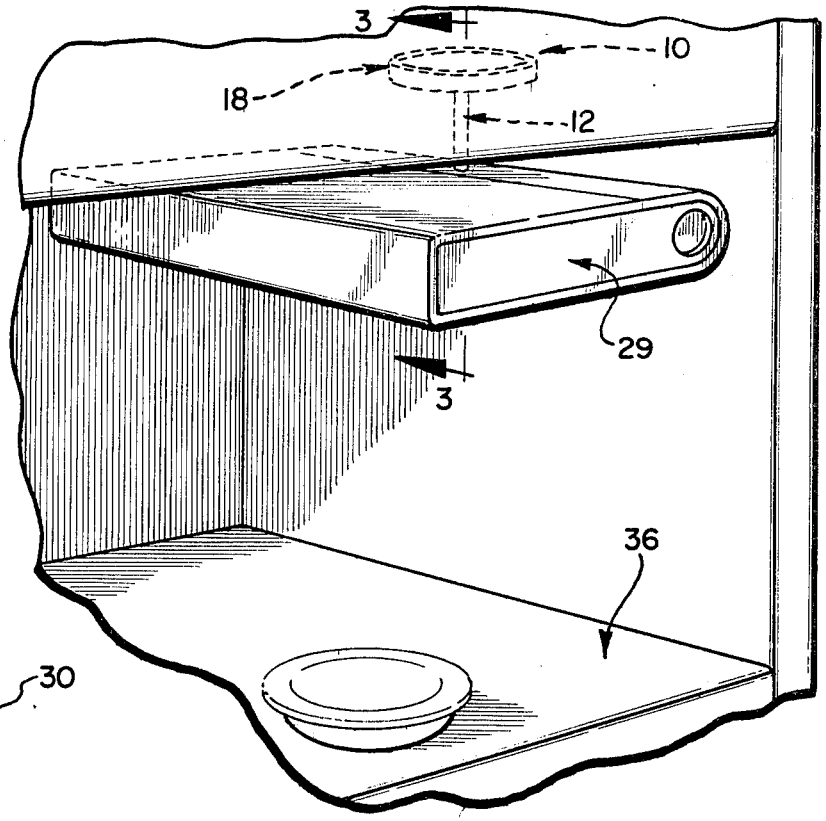
FIG. 1 is a perspective view of a light fixture mounted over a table or the like work surface in suspended fashion, on a magnetic mounting support according to the invention.

Referring now to the drawing in greater detail wherein like numerals have been employed throughout the various views to designate similar components, a magnetic mounting support, according to the invention and generally indicated by the numeral 10, includes an elongated support shaft 12 fabricated preferably of chrome-plated metal, having a threaded end 14. Directly adjacent threaded end 14 of the shaft is an enlarged stop 16.

The mounting support also includes a base 18, shown in the drawing as being circular or disk shaped, but which could assume any desirable shape. Base 18, like support shaft 12, is preferably fabricated of chrome-plated metal. Base 18 is cup shaped, having a top wall 17 surrounded by a shallow rim 20, extending thereabout. Base 18 includes a toroidal shaped permanent magnet 22 received therein in engagement with surface 19 of top wall 17, the purpose of the magnet being to removably attach the mounting support to metallic surfaces and, more particularly, to the underside 24 of a metallic shelf 26 for supporting an object such as, for example, light fixture 29, in suspended fashion, as illustrated in FIG. 1.

The mounting support is assembled by insertion of threaded end 14 of elongated support shaft 12 into an aperture, such as 25, defined in top wall 17 of base 18. The insertion of threaded end 14 of support shaft 12 into aperture 24 of the base is limited by the engagement of stop 16 with outer surface 21 of top wall 17.

Aperture 25 of base 18 is surrounded by toroidally shaped magnet 22 to form a recess 26 in which a resilient member, preferably rubber washer 28, is received on threaded end 14 of the support shaft. Rubber washer 28 is selected to have a thickness sufficient to provide proper shock absorptive characteristics in the environment of the mounting support according to the invention. Other suitable resilient members may include a small helically wound spring surrounding the threaded end of the support shaft, a metallic spring steel washer, or similar member. Washer 28 is positioned in abutting relation to surface 19 of top wall 17 of base 18. A second washer 30, preferably of a locking type, having radially inwardly facing teeth, such as 32, is also received on threaded end 14 of shaft 12 in abutting relation with rubber washer 28. A nut 34 is received on threaded end 14 of shaft 12 and is tightened down to secure the support shaft and base in a joined condition.

Once assembled, magnetic base 18 is attached to the underside of a shelf or other metallic surface merely by placing the base in contact therewith. The powerful magnetic force created by permanent magnet 22 removably secures the mounting support 10 to the metallic surface.

Any object such as, for example, light fixture 29, which can be mounted on support shaft 12 and mounted thereon, can be suspended or hung from the mounting support such as, for example, in the case of light fixture 29, to illuminate a work area 36 (FIG. 1) below the shelf. While an elongated support shaft 12 has been shown, a variety of attachment pieces may be mounted on base 18 in similar fashion for supporting objects other than light fixture 29.

Figure 2:
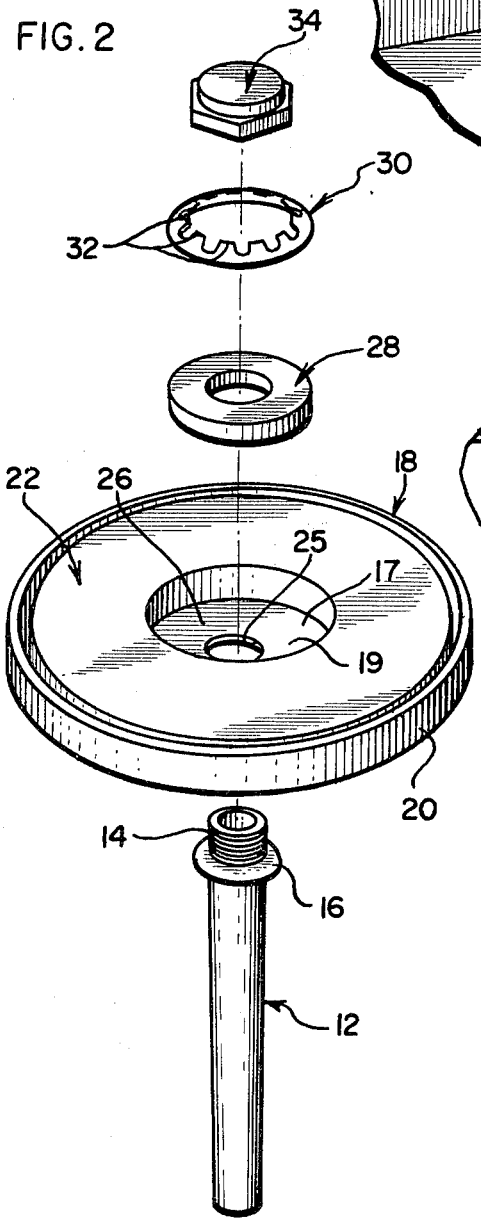
FIG. 2 is an enlarged, exploded, isometric view of the magnetic mounting support according to the invention.
Figure 3:
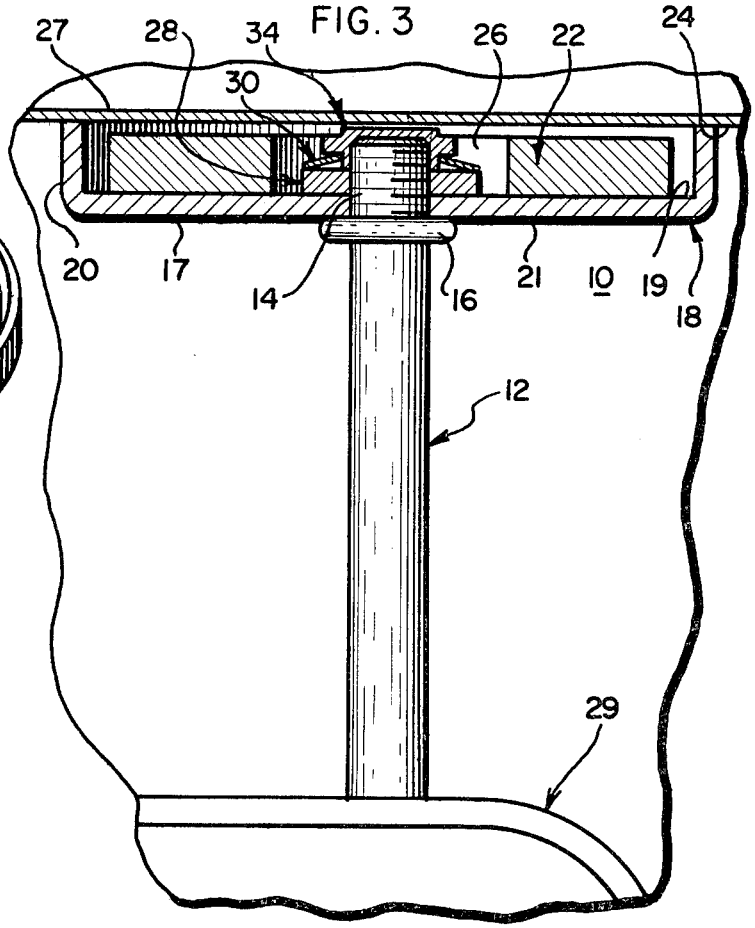
FIG. 3 is an enlarged, sectional view of the magnetic mounting support and light fixture of FIG. 1 taken along the lines 3—3 thereof.

The attachment of support shaft 12 to magnetic base 18 by means of resilient washer 28, washer 30, and nut 34, provides a shock absorptive assembly which prevents, under most circumstances, the release of the magnetic mounting support from the underside of a metallic shelf because of the inadvertent dropping or forcible placement of an object on the upper side 27 of the shelf (FIG. 2). Force applied to upper side 27 of shelf 26 is absorbed by rubber washer 28, thereby minimizing the transmission of such force to support shaft 12 and light fixture 29. As such, the resultant pull against base 18 is minimized, thereby preventing release of the magnetic base from shelf surface 24. While a particular embodiment of the invention has been shown and described, it should be understood that the invention is not limited thereto since many modifications may be made. It is therefore contemplated to cover by the present application any and all such modifications as fall within the true spirit and scope of the appended claims.

I claim:

1. A shock absorbtive mounting support for a light fixture, including in combination:

a base including magnet means for magnetically securing said mounting support on a magnetic support surface, said base defining an aperture therethrough;

support means adapted for mounting said light fixture thereon, including an end portion dimensioned for receipt in said aperture of said base, said support means including a support shaft having a threaded end portion and a stop defined adjacent said threaded end portion, said threaded end portion being inserted into said aperture of said base, the extend of insertion of said threaded end portion being limited by said stop;

resilient shock absorptive means received on said end portion of said support means in abutting relation with said base, said resilient shock absorptive means comprising resilient washer means received on said threaded end portion of said support shaft;

fastener means received on said end portion of said support means in abutting relation with said resilient, shock absorptive means, said fastener means including a nut received on said threaded end portion, said nut being tightened down to secure said support shaft and said base in joined relation; and concave washer means received on said threaded end portion of said support shaft between said nut and said resilient washer means.

2. A shock absorptive mounting arrangement as claimed in claim 1 wherein said concave washer means received on said threaded end portion of said support shaft between said nut and resilient washer means comprises a concave locking washer means.

3. A shock absorptive mounting support as claimed in claim 1 wherein said resilient washer means includes a toroidally-shaped, rubber member having a predetermined thickness.

4. A shock absorptive magnetic mounting support for mounting a light fixture on the underside of a metallic support surface, said mounting support including in combination;

a base including magnetic means for magnetically securing said mounting support on said metallic support surface, said base defining an aperture therethrough;

support shaft means adapted to receive said light fixture thereon, said support shaft means including a threaded end portion and stop means defined on said shaft adjacent said threaded end portion, said threaded end portion being inserted into said aperture in said base, the extent of insertion being limited by said stop means;

a resilient, shock absorber member received on said threaded end of said support shaft and positioned in an abutting relation with said base;

a nut fastener received on said threaded end portion of said support shaft, said nut fastener being tightened down to secure said support shaft and said base in joined relation; and concave washer means received on said threaded end portion of said support shaft between said nut fastener and said resilient shock absorber member.

5. A shock absorptive magnetic mounting support as claimed in claim 4 wherein said resilient, shock absorber member comprises a toroidally-shaped, resiliently deformable member having a predetermined thickness.

6. A shock absorptive, magnetic mounting support as claimed in claim 5 wherein said concave washer means comprises a concave locking washer means mounted on said threaded end portion of said support shaft in abutting relation with said shock absorber member for securing said nut in tight engagement on said threaded end portion of said support shaft.

7. A shock absorptive magnetic mounting support as claimed in claim 4 wherein said base includes a flat metallic top wall surrounded by a metallic rim defining a cavity and a permanent magnet received in said cavity.

8. A shock absorptive magnetic mounting support as claimed in claim 7 wherein said base is disk shaped, wherein said magnet is toroidally shaped having a central opening and wherein said aperture in said base is in alignment with said central opening of said magnet, said central opening of said magnet defining a cavity for receiving said resilient shock absorber member and nut fastener.

* * * * *